US005179067A

United States Patent [19]

Chang et al.

[11] Patent Number: 5,179,067

[45] Date of Patent: Jan. 12, 1993

[54] HEAT-SENSITIVE RECORDING MATERIAL

[75] Inventors: Suk K. Chang; Dong J. Yang; Kyu C. Paik; Don W. Kim; Jae S. Ryu, all of Kyungki, Rep. of Korea

[73] Assignee: Chonju Paper Mfg. Co., Ltd., Seoul, Rep. of Korea

[21] Appl. No.: 704,483

[22] Filed: May 23, 1991

[30] Foreign Application Priority Data

Oct. 29, 1990 [KR] Rep. of Korea ..... 90-17390
Feb. 13, 1991 [KR] Rep. of Korea ..... 91-2516
Feb. 13, 1991 [KR] Rep. of Korea ..... 91-2517

[51] Int. Cl.[5] ..... B41M 5/30
[52] U.S. Cl. ..... 503/209; 503/208; 503/225
[58] Field of Search ..... 503/208, 209, 225

[56] References Cited

U.S. PATENT DOCUMENTS 4,842,981 6/1989 Sanders et al. ..... 503/225

FOREIGN PATENT DOCUMENTS 45-14039 5/1970 Japan .
51-27599 8/1976 Japan .

*Primary Examiner*—Pamela R. Schwartz
*Attorney, Agent, or Firm*—Armstrong, Westerman, Hattori, McLeland & Naughton

[57] ABSTRACT

The present invention relates to a color forming solution including the benzoin derivatives as a sensitizer.

The benzoin derivatives used as a sensitizer in the present invention are represented by the following general formula (I)

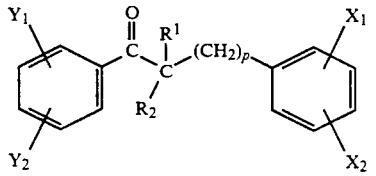

(I)

5 Claims, No Drawings

HEAT-SENSITIVE RECORDING MATERIAL

FIELD OF THE INVENTION

This invention relates to a heat-sensitive recording material having improved color forming properties, and more particularly, to a heat-sensitive recording material having benzoin derivatives used as the sensitizer.

DESCRIPTION OF THE PRIOR ART

The heat sensitive recording material in which the color images can be obtained thermally by the reaction between a colorless or pale dye and a color developer has been disclosed. The lactone derivatives (color former) and the acid materials (color developer) have been known as the main components of the heat sensitive recording materials. The paper coated with this color forming solution has been usually used as a heat sensitive recording sheet. But the paper used as a heat sensitive recording sheet has to be maintained at 140°-150° C. in order to obtain the improved color images.

Heat sensitive recording materials comprising of a colorless dye (color former) and an acidic compound (color developer), for example, an organic acid or a phenolic compound, have been disclosed in Japanese Patent Publication No. 14039/70. And in Japanese Laid-open Patent Publication No. 74762/79, the heat sensitive recording material comprising of a color former and benzyl-p-hydroxybenzoate (a color developer) has been disclosed. If they are used in a thermal head printer, however, the above mentioned materials do not fully show the color forming sensitivity. To obtain better color forming sensitivity, a sensitizer is added to the color forming solution coated in heat-sensitive recording sheet. The materials used for the sensitizer-wax derivatives, fatty acidic anilide, acetanilide and stearic anilide were disclosed in Japanese Laid-open Patent Publication No. 1923/73 and Japanese Patent Publication Nos. 27599/76, 4160/68, 139740/79, respectively.

In the case of using wax derivatives as a sensitizer, the uncompatibility with organic acid prevents it from being widely used. And in the case of using fatty acidic anilide as a sensitizer, the diffusion of printing materials in the heat sensitive recording sheet is the problem. If we use acetanilide as a sensitizer, its sublimation property prevents the color forming solution from being preserved stably in a heat sensitive recording sheet.

Recently, the compounds which have ester or ether bonds among the groups consisting of aralkyl, phenyl, biphenyl, naphtyl and alkyl have been researched as a sensitizer. But the compounds selected from the ester or the ether groups do not show the improved preservability and stability, even though they show the improved color forming sensitivity.

SUMMARY OF THE INVENTION

The object of the present invention is to provide a heat sensitive recording material which shows improved color forming sensitivity and improved preservability by using benzoin derivatives as a sensitizer. To obtain the heat sensitive recording sheet in this invention, the color forming solution including the benzoin derivatives is coated to the base paper.

DETAILED DESCRIPTION OF THE INVENTION

The benzoin derivatives used as a sensitizer in the present invention are represented by the following general formula (I)

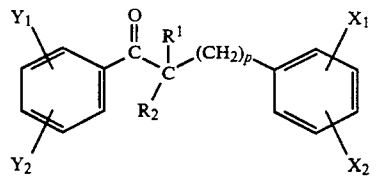

(I)

wherein p is an integer of 0 or 1, $X_1$ and $X_2$ are selected from the group consisting of hydrogen, halogens, nitro, acyl, aryl, aryloxy, linear or branched $C_1$-$C_{10}$alkyl and $C_1$-$C_{10}$alkyloxy, $Y_1$ and $Y_2$ are also selected from the group consisting of hydrogen, halogens, nitro, acyl, aryl, aryloxy, linear or branched $C_1$-$C_{10}$alkyl and $C_1$-$C_{10}$alkyloxy, $R_1$ is selected from the group consisting of hydrogen, cyano, hydroxy, aralkyloxy, alkyloxy, aryloxy and —OR (wherein R represents $C_1$-$C_{10}$alkoxycarbonyl, aryloxy carbonyl), $R_2$ is selected from the group consisting of hydrogen, linear or branched $C_1$-$C_{10}$alkyl, $C_1$-$C_{10}$alkenyl, $C_1$-$C_{10}$hydroxyalkyl, cyclohexyl, aryl and

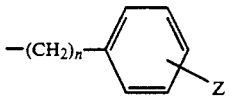

(wherein n is an integer of 1,2 or 3, and Z is selected from the group consisting of hydrogen, halogens, lower alkyl, nitro, alkoxy, acyl).

The colorless or pale dye (color former) coated on the color forming layer can be selected from the group comprising of triphenylmethane derivatives, triarylmethane derivatives, lactone derivatives and fluorane derivatives. The leuco dye is preferred as a color former coated in the heat sensitive recording sheet. Any color developers are usable if they react with the said color formers.

Among these color formers, 3-dietylamino-6-methyl-7-anilinofluorane, 3-diethylamino-7-(o-chloroanilino)-fluorane, 3-diethylamino-7-(m-fluoromethylanilino)-fluorane, 3-diethylamino-7-(o-fluoroanilino)-fluorane, are preferable. As a color developer, bisphenol A or 2, 2-bis(α-hydroxyphenyl) pentane are preferable.

100 parts of color former and 100-1000 parts of color developer by weight are normally mixed.

The sensitizers represented by formula(I) in the present invention are used for improving the color forming sensitivity and preservability of heat sensitive recording materials. The sensitizers used in the present invention are benzoin derivatives represented by the formula(I) having a melting point of 70°-150° C. The preferred compounds for sensitizer are in the melting point range of 80°-120° C. The preferred sensitizers (heat fusible materials) are, for example, the following compounds having the described melting points.

Deoxy-4'-methyl benzoin (96° C.)

-continued

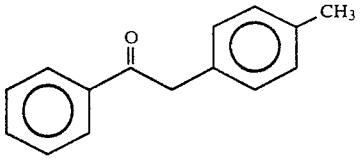

Deoxy-4-methyl benzoin (108° C.)

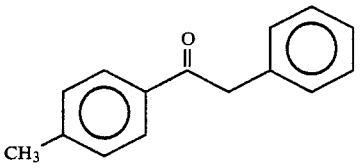

Deoxy-4,4'-dimethyl benzoin (101° C.)

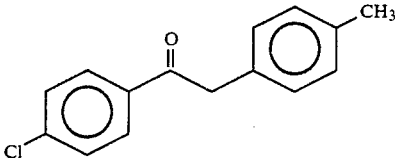

Deoxy-4-methoxy benzoin (78° C.)

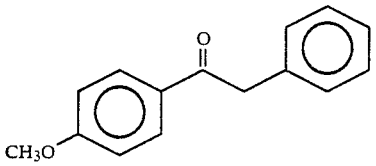

Deoxy-4-chloro benzoin (103° C.)

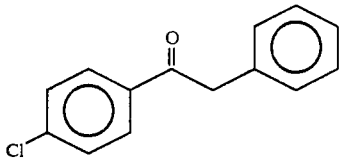

Deoxy-4-bromo benzoin (109° C.)

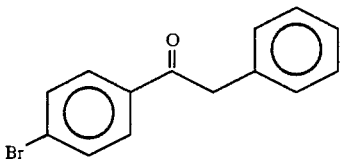

Deoxy-2,4-dimethyl benzoin (98° C.)

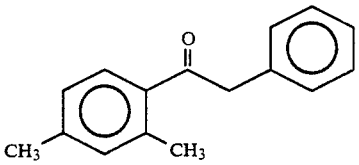

Deoxy-2',4'-dimethyl benzoin (108.5° C.)

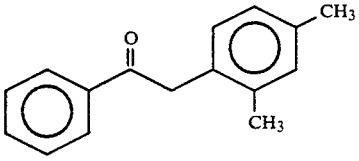

Deoxy-3,4-dimethyl benzoin (95° C.)

-continued

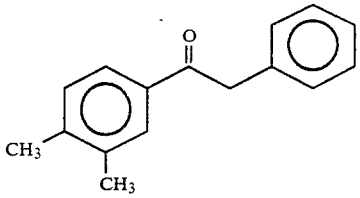

1,2-diphenyl-2-acetyloxyethanone (74° C.)

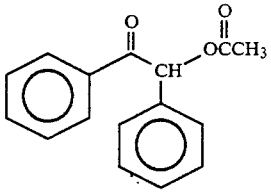

1,2-diphenyl-2-ethoxycarbonyloxyethanone (73° C.)

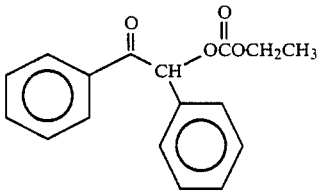

1,2-diphenyl-2-methoxycarbonyloxyethanone (89° C.)

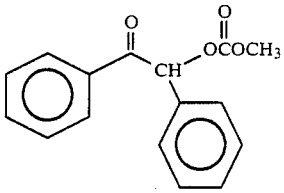

1,2-diphenyl-2-butanoyloxyethanone (69° C.)

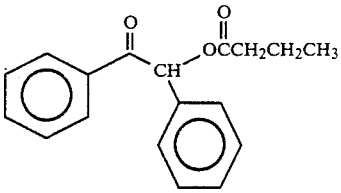

1,2-diphenyl-2-phenoxycarbonyloxyethanone (74° C.)

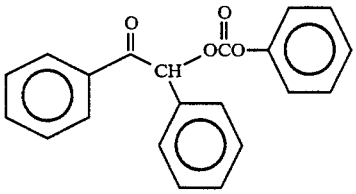

α-Benzyl benzoin (117° C.)

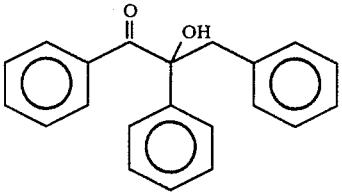

Benzoin phenyl ether (87° C.)

-continued

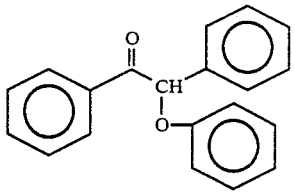

α-Benzyl benzoin benzyl ether (108° C.)

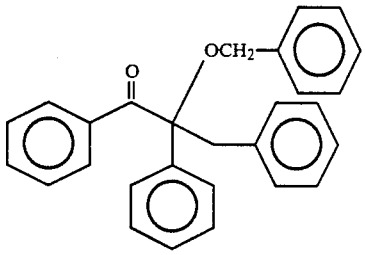

Furthermore, the following compounds are examples of heat-fusible materials (sensitizers) of the invention (in parentheses are given the melting points): 4'-methoxy benzoin (108° C.), 4-methoxy benzoin (106° C.), 2,2'-dimethoxy benzoin (99° C.), 4'-methyl benzoin (116° C.), 4,4'-Diisopropyl benzoin (101° C.), 2,4,6-triisopropyl benzoin (117° C.), 4,4'-dimethoxy benzoin (110° C.) and α-hydroxy methyl benzoin (84° C.).

The sensitizers (heat fusible materials) of the present invention can be used as one component or a mixed composition of more than 2 components. The quantity of added sensitizer is preferably 100–350% by weight compared to the quantity of basic dye. If the weight of sensitizer exceeds more than 350% of the basic dye, the compatibility of the reaction mixture is not stable.

The benzoin derivatives represented by formula(I) can be synthesized by the known process or by purifying commercially available crude materials. For the preparation of heat sensitive recording materials of this invention, water is added as a dispersing media and the mixture is pulverized and dispersed by a sand mill to the extent that the particle size of the mixture is lower than 10 microns. Zinc stearate can be added to the mixture in order to increase the mobility between thermal head and sensitive recording materials. To obtain the heat sensitive recording sheet, the heat sensitive recording materials are coated to supporting materials, for example, paper, synthetic textile or synthetic resin film, by conventional coating methods including air knife coating and blade coating. The preferable coating amount is 2–15 g dry weight of mixture per 1 square meter of base paper. The heat sensitive recording sheet coated by the mixture of this invention shows high color forming property together with high whiteness and preservability.

The present invention is explained in more detail in the following examples. These examples, however, are only illustrative and are not to be regarded as limitations for the scope of this invention.

EXAMPLE 1

Dispersion A (containing a dye)

| | |
|---|---|
| 3-Diethylamino-6-methyl-7-anilino-fluorane | 1.0 parts |
| Deoxy-4'-methyl benzoin (m.p 96° C.) | 2.0 parts |
| 10% aqueous solution of polyvinyl alcohol | 3.0 parts |
| Water | 5.0 parts |
| Total | 11.0 parts |

Dispersion B (containing an acidic substance)

| | |
|---|---|
| Bisphenol A | 2.0 parts |
| Calcium carbonate | 2.5 parts |
| Zinc sterate | 0.5 parts |
| 10% aqueous solution of polyvinyl alcohol | 7.0 parts |
| Water | 10.0 parts |
| Total | 22.0 parts |

Dispersion A and B were separately prepared by mixing, pulverizing and dispersing the indicated components. By pulverizing the mixture with a sand mill the average particle size of the mixture was 3 micro meters. A heat sensitive recording material was obtained by mixing 11.0 parts of dispersion A and 22 parts of dispersion B. The obtained material was coated on high quality paper weighing 50 g per $m^2$ to an amount of 7.0 g dry weight of material per $m^2$. The heat sensitive recording sheet having excellent color forming sensitivity and whiteness was prepared according to this invention.

EXAMPLE 2

A heat sensitive recording sheet was prepared in the same manner as in example 1 except that 1,2-diphenyl-2-methoxycarbonyloxyethanone was used instead of deoxy-4'-methyl benzoin in the preparation of dispersion A.

EXAMPLE 3

A heat sensitive recording sheet was prepared in the same manner as in example 1 except that 1,2-diphenyl-2-phenoxycarbonyloxyethanone was used instead of deoxy-4'-methyl benzoin in the preparation of dispersion A.

EXAMPLE 4

A heat sensitive recording sheet was prepared in the same manner as in example 1 except that deoxy-4-methyl benzoin was used instead of deoxy-4'-methyl benzoin in the preparation of dispresion A.

EXAMPLE 5

A heat sensitive recording sheet was prepared in the same manner as in example 1 except that deoxy-4,4'-dimethyl benzoin was used instead of deoxy-4'-methyl benzoin in the preparation of dispersion A.

EXAMPLE 6

A heat sensitive recording sheet was prepared in the same manner as in example 1 except that deoxy-4-methoxy benzoin was used instead of deoxy-4'-methyl benzoin in the preparation of dispersion A.

EXAMPLE 7

A heat sensitive recording sheet was prepared in the same manner as in example 1 except that deoxy-4-chloro benzoin was used instead of deoxy-4'-methyl benzoin in the preparation of dispersion A.

EXAMPLE 8

A heat sensitive recording sheet was prepared in the same manner as in example 1 except that α-hydroxy methyl benzoin was used instead of deoxy-4'-methyl benzoin in the preparation of dispersion A.

EXAMPLE 9

A heat sensitive recording sheet was prepared in the same manner as in example 1 except that benzoin phenyl ether was used instead of deoxy-4'-methyl benzoin in the preparation of dispersion A.

EXAMPLE 10

A heat sensitive recording sheet was prepared in the same manner as in example 1 except that deoxy-2',4'-dimethyl benzoin was used instead of deoxy-4'-methyl benzoin in the preparation of dispersion A.

COMPARATIVE EXAMPLE 1

A heat sensitive recording sheet was prepared in the same manner as in example 1 except that stearamide was used instead of deoxy-4'-methoxy benzoin in the preparation of dispersion A.

COMPARATIVE EXAMPLE 2

A heat sensitive recording sheet was prepared in the same manner as in example 1 except that deoxy-4'-methyl benzoin was not added to dispersion A, and the amount of dispersion A was decreased to 9.0 parts. But this sheet showed an inferior color forming sensitivity.

Table 1 shows the coloring density and whiteness of examined compounds from the examples.

TABLE 1

The coloring density and whiteness of examined compounds

| Run No. | Compound Name | melting Point (°C.) | Coloring Density 20 | 30 | 40 | Whiteness (%) |
|---|---|---|---|---|---|---|
| Example 1 | Deoxy-4'-methyl benzoin | 96 | 0.40 | 1.09 | 1.29 | 82.1 |
| Example 2 | 1,2-diphenyl-2-methoxycarbonyloxyethanone | 89 | 0.59 | 1.15 | 1.32 | 83.4 |
| Example 3 | 1,2-diphenyl-2-phenoxycarbonyloxyethanone | 74 | 0.41 | 1.08 | 1.31 | 82.0 |
| Example 4 | Deoxy-4-methyl benzoin | 108 | 0.41 | 1.07 | 1.30 | 82.3 |
| Example 5 | Deoxy-4,4'-dimethyl benzoin | 101 | 0.43 | 1.12 | 1.31 | 82.5 |
| Example 6 | Deoxy-4'-methoxy benzoin | 78 | 0.38 | 1.10 | 1.28 | 82.6 |
| Example 7 | Deoxy-4'-chloro benzoin | 103 | 0.45 | 1.16 | 1.30 | 83.0 |
| Example 8 | α-Hydroxy methyl benzoin | 84 | 0.40 | 1.09 | 1.29 | 82.1 |
| Example 9 | Benzoin phenylether | 87 | 0.42 | 1.11 | 1.31 | 82.4 |
| Example 10 | Deoxy-2',4'-dimethyl benzoin | 108.5 | 0.44 | 1.15 | 1.32 | 82.9 |
| Comparison Example 1 | Stearamide | 80 | 0.21 | 0.72 | 0.92 | 76.8 |
| Comparison Example 2 | — | | 0.11 | 0.31 | 0.53 | 76.8 |

*Applied energy (mj/mm)
The optical density of the image was measured by a Macbeth densitometer (TR-927, made by Macbeth Co., U.S.A.)

We claim:

1. In a heat sensitve recording material composed of a colorless or pale dye, a color developer and a sensitizer, the improvement comprising including benzoin derivatives represented by formula (I) as the sensitizer to obtain improved color forming sensitivity and preservability of the said heat sensitive recording material:

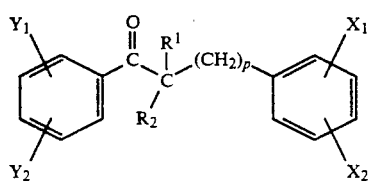

(I)

wherein p is an integer of 0 or 1, $X_1$ and $X_2$ are selected from the group consisting of hydrogen, halogens, nitro, acyl, aryl, aryloxy, linear, branched $C_1$–$C_{10}$alkyl and $C_1$–$C_{10}$ alkyloxy, $Y_1$ and $Y_2$ are selected from the group consisting of hydrogen, halogens, nitro, acyl, aryl, aryloxy, linear $C_1$–$C_{10}$alkyloxy, and branched $C_1$–$C_{10}$alkyloxy, $R_1$ is selected from the group consisting of hydrogen, cyano, hydroxy, aralkyloxy, alkyloxy, aryloxy and —OR wherein R represents $C_1$–$C_{10}$alkyl, $C_1$–$C_{10}$acyl, $C_1$–$C_{10}$alkoxycarbonyl, aryloxy carbonyl, $R_2$ is selected from the group consisting of hydrogen, linear $C_1$–$C_{10}$alkyl, branched $C_1$–$C_{10}$alkyl, $C_1$–$C_{10}$alkenyl, $C_1$–$C_{10}$hydroxyalkyl, cyclohexyl, aryl and

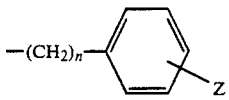

wherein n is an integer of 1,2, or 3, and Z is selected from the group consisting of hydrogen, halogens, lower alkyl, nitro, alkoxy, and acyl.

2. The heat sensitive recording material according to claim 1 wherein $X_1$, $X_2$, $Y_1$ and $Y_2$ are each hydrogen and p is an integer of 0.

3. The heat sensitive recording material according to claim 1 wherein $R_1$ and $R_2$ are each hydrogen and p is an integer of 0 or 1.

4. The heat sensitive recording material according to claim 1 wherein $R_1$ is hydrogen, $R_2$ is OR and p is an integer of 0.

5. The heat sensitive recording material according to claim 1, wherein the benzoin derivative is at least one member selected from the group consisting of deoxy-4'-methyl benzoin, 1,2-diphenyl-2-methoxycarbonyloxyethanone, 1, 2-diphenyl-2-phenoxycarbonyloxyethanone, deoxy-4-methyl benzoin, deoxy-4,4'-dimethyl benzoin, deoxy-4-methoxy benzoin, deoxy-4-chloro benzoin, α-hydroxy methyl benzoin, benzoin phenyl ether, deoxy-2',4'-dimethyl benzoin, deoxy-4-bromo benzoin, deoxy-3,4-dimethyl benzoin, 1,2-diphenyl-2acetyloxyethanone, 1,2-diphenyl-2-ethoxy carbonyloxyethanone, 1,2-diphenyl-2-butanoyloxyethanone, deoxy-2,4-dimethyl benzoin, α-benzyl benzoin and α-benzyl benzoin benzyl ether.

* * * * *